United States Patent [19]

Koinuma

[11] 4,091,252

[45] May 23, 1978

[54] MICROWAVE HEATING APPARATUS

[75] Inventor: Tokuju Koinuma, Kawasaki, Japan

[73] Assignee: Tokyo Shibaura Electric Co., Ltd., Kawasaki, Japan

[21] Appl. No.: 693,889

[22] Filed: Jun. 8, 1976

[30] Foreign Application Priority Data

Jun. 9, 1975 Japan ..... 50-68531

[51] Int. Cl.[2] ..... H05B 9/06

[52] U.S. Cl. ..... 219/10.55 R; 219/10.55 F

[58] Field of Search ..... 219/10.55 F, 10.55 R, 219/10.55 E, 10.55 D, 10.55 M

[56] References Cited

U.S. PATENT DOCUMENTS

| | | | |
|---|---|---|---|
| 2,778,911 | 1/1957 | Valentine | 219/10.55 D |
| 2,961,520 | 11/1960 | Long | 219/10.55 F |
| 3,692,968 | 9/1972 | Yasuoka | 219/10.55 E |
| 3,783,219 | 1/1974 | Tateda | 219/10.55 D |
| 3,829,649 | 8/1974 | Igarashi | 219/10.55 B |
| 3,934,106 | 1/1976 | MacMaster et al. | 219/10.55 F X |
| 3,967,154 | 6/1976 | Tashiro et al. | 219/10.55 R X |

*Primary Examiner*—Arthur T. Grimley
*Attorney, Agent, or Firm*—Oblon, Fisher, Spivak, McClelland & Maier

[57] ABSTRACT

A microwave heating apparatus comprises a heating oven chamber for receiving a substance to be heated and a magnetron with an anode cylinder for generating heat. The magnetron is positioned above the oven chamber, and, not only its output antenna to emit microwaves to the substance, but also its anode cylinder are exposed within the oven chamber. The heat generated by the anode cylinder is supplied into the oven chamber to elevate the temperature therein. As a result, the substance in the oven chamber is heated not only by the microwave but by the heat from the anode cylinder.

8 Claims, 7 Drawing Figures

MICROWAVE HEATING APPARATUS

BACKGROUND OF THE INVENTION

This invention relates to a microwave heating apparatus and in particular an improvement in the arrangement of a magnetron in a heating oven chamber of a microwave heating apparatus.

A conventional microwave heating apparatus such as a microwave oven etc. is so arranged that only the output section, i.e., an antenna, of a magnetron is projected within a heating oven chamber in which a substance to be heated is placed. That is, the magnetron is mounted on the wall surface of the heating oven chamber, only the output section of the magnetron is projected within the heating oven chamber and a magnetron body including an anode cylinder, a magnet device etc. is positioned outside of the oven chamber. Where the magnetron is so arranged that a microwave is radiated through a waveguide toward a substance to be heated, only the output section of the magnetron is located in the waveguide and the remaining magnetron body is arranged outside the waveguide. The reason why the magnetron is so arranged is as follows. In order for the magnetron to effect a proper operation it is necessary that the magnetron body, particularly the anode cylinder, is cooled through direct exposure to an outer air. When the magnetron is in an oscillating state, the temperature of the magnetron body is raised up to about 400° to 500° C. If the magnetron body is left heated at that temperature, the magnetron ceases to be operated properly.

A heat generated at the anode cylinder is generally known as an anode loss and this heat energy accounts for 40 to 50% of a whole electric energy applied to the magnetron and the remaing 60 to 50% electric energy is substantially converted into a microwave output. Almost all of such an unconverted energy is dissipated outside of the heating oven chamber without being utilized.

Furthermore, since the magnetron body is placed outside of the heating oven chamber, the microwave heating apparatus itself is made large-sized, taking up an extra space.

SUMMARY OF THE INVENTION

An object of this invention is to provide a microwave heating apparatus which permits an electric energy applied to the magnetron to be effectively applied to a to-be-heated substance received within the heating oven chamber.

Another object of this invention is to provide a small-sized microwave heating apparatus which removes any extra space as far as possible.

Another object of this invention is to provide a microwave heating apparatus capable of suitably irradiating with a microwave a to-be-heated substance within a heating oven chamber.

A magnetron of a microwave heating apparatus according to this invention is so mounted that at least part of an anode cylinder, as well as an output antenna of the magnetron, is disposed in a heating oven chamber. Since part of the anode cylinder is disposed in the heating oven chamber, the anode cylinder which generates a heat during the operation of the heating apparatus serves as an auxiliary heating source for heating a substance through a natural heat convection as well as a forced heat convection. In consequence, the portion of the heat generated due to the anode loss of the magnetron is so effectively used, substantially elevating a heating efficiency of the microwave heating apparatus. Furthermore, since part of the anode cylinder as well as the output antenna is disposed in the heating oven chamber, an outer extra space can be decreased, making it easy to design a microwave heating apparatus and at the same time attaining a substantially compact microwave heating apparatus.

DESCRIPTION OF THE PREFERRED EMBODIMENT

Figure 1:
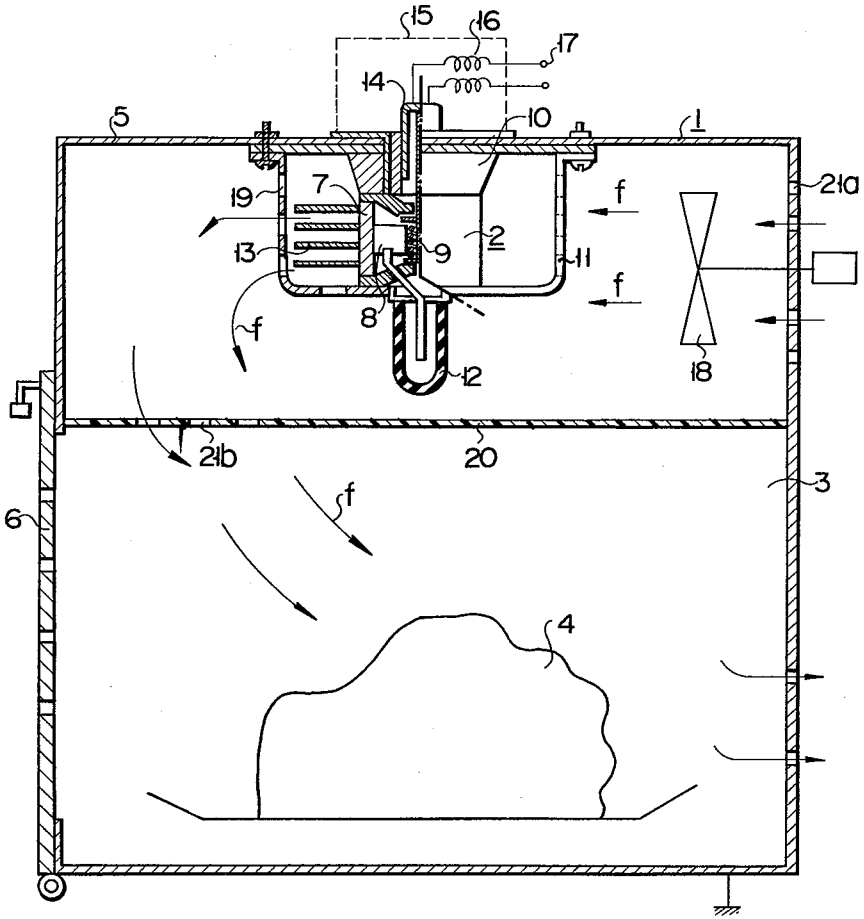
FIG. 1 is a cross-sectional view briefly showing the arrangement of a microwave heating apparatus according to one embodiment of this invention.

FIG. 1 briefly shows a typical microwave heating apparatus according to one embodiment of this invention. In FIG. 1 the microwave heating apparatus 1 includes a magnetron 2 and a box-like heating oven chamber 3 in which a substance 4 to be irradiated with a microwave is received. The heating oven chamber 3 has a wall 5 made of an electroconductive material and has a substance access door 6 at the side surface of the wall. Although the magnetron 2 mounted on the top inner surface of the heating oven chamber 3 is of an ordinary vane type, it is not restricted to the vane type magnetron. As will be evident from FIG. 1 the magnetron 2 comprises an anode cylinder 7, a plurality of vanes 8 projecting from the inner wall surface of the anode cylinder 7 toward the central axis of the anode cylinder, a cathode 9 disposed along the central axis of the anode cylinder 7, a permanent magnet 10 mounted above the anode cylinder 7, a yoke 11 magnetically coupled to the permanent magnet 10, and an output antenna 12 disposed below the anode cylinder 7 to permit a microwave energy generated in resonance cavities among the vanes to be radiated outside of the magnetron. Within the magnetron 2 heat dissipating fins 13 are provided on the outer periphery of the anode cylinder 7.

In a conventional microwave heating apparatus only an output antenna projects into a heating oven chamber 3. With the microwave heating apparatus according to this invention, a magnetron body comprising the anode cylinder 7, yoke 11, permanent magnet 10 and cooling fin 13, as well as the output antenna, is placed within the heating oven chamber 3. On the conventional microwave heating apparatus, only a cathode stem 14, shield box 15, filter element 16 and cathode terminal 17 are disposed outside of the heating oven chamber 3. The magnetron 2 is mounted on the heating top wall 5 of the heating oven chamber 3 by inserting the cathode stem 14 through a cathode stem hole of the top wall of the heating oven chamber 3 and fastening the magnetron body to the top wall 5 of the heating chamber 3 by bolts, nuts etc. The shield box 15 surrounds the cathode stem 14 so as to obtain an electric wave shielding effect, i.e., to prevent a microwave from leaking through the cathode stem hole.

With the above-mentioned arrangement the anode cylinder 7 is disposed within the heating oven chamber 3 and a heat generated during the operation of the magnetron from the anode cylinder 7 is radiated in the heating oven chamber 3. The heat radiated in the heating oven chamber 3 is used as an auxiliary heat for the substance to be heated, as will be later described.

In this embodiment a heat stirring fan 18 is placed in the neighborhood of the magnetron body to positively use the heat generating in the anode cylinder 7 as an auxiliary heat for the substance 4, and the fan 18 is made of a metal or a dielectric material and serves as a stirrer for stiring the microwave in the heating oven chamber 3. A heat current in the anode cylinder 7, which is created by the fan 18, is forcedly circulated toward the substance as indicated by arrows *f*. A microwave irradiated from the output antenna 12 is stirred and uniformly directed toward the substance 4. The heat current can be effectively circulated by providing suitable holes 21*a* (for example, a diameter of 2 to 3 mm) in the inner wall of the oven chamber 3 and near to the fan 18 to permit an entry of an outer air and providing a means for exhausting an air within the oven chamber 3. It is needless to say that various means should be taken against a possible accident, such as an electric wave leakage etc., as occuring by, for example, inserting a fine wire through a hole 21*a* in the wall of the oven chamber 3. The yoke 11 may be located in a suitable position to permit full circulation of the air current *f* or air passage holes 19 be provided in the yoke 11. In this embodiment, In order to prevent steam from the substance 4 from being deposited onto the magnetron 2 the oven chamber 3 is partitioned by a dielectric partition wall 20 having less microwave dissipation and air passage holes 21*b* are provided in the partition wall 20 so as not to prevent the circulation of a hot air current. Although the holes 21*a* may be omitted, the provision of such holes offers the advantage of attaining full circulation of the hot air current.

In the embodiment in FIG. 1 a heat generated by the anode loss can be effectively utilized for heating the substance 4. When the magnetron is operated for a certain length of time, for example, a few minutes, the above-mentioned feature provides excellent heat efficiency. To explain more in detail, the heat from the anode loss is directed by the fan 18 toward the substance 4, while heating an air in the oven chamber 3 as a whole, to cause the substance 4 to be heated.

The other embodiments of this invention will be explained by referring to FIGS. 2 to 7 in which like reference numerals are employed to designate like parts or elements.

Figure 2:
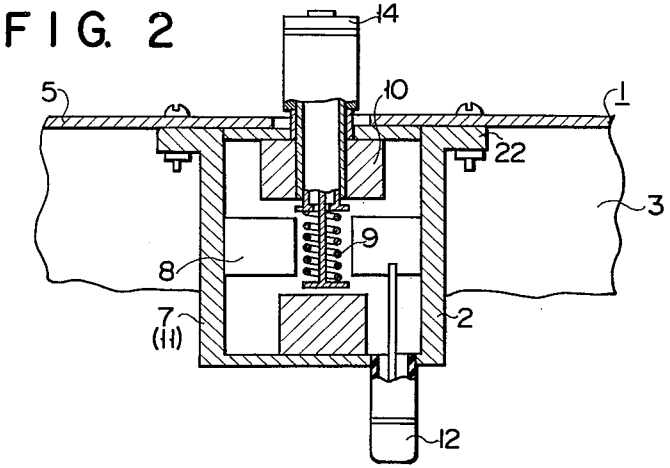
FIG. 2 is a cross-sectional view partly showing a modified form of the microwave heating apparatus shown in FIG. 1.

FIG. 2 shows a magnetron 2 and part of an oven chamber wall 5 and the remaining portion is omitted for convenience of explanation. As will be evident from FIG. 2 the magnetron 2 is of the type in which a permanent magnet 10 is disposed within an anode cylinder 7, and lacks an anode cylinder cooling fin 13 which usually be provided on the outer periphery of the anode cylinder 7. Instead of the fin 13, the magnetron 2 has a thick side wall with a frange 22. The frange 22 is mounted directly on the inner top wall of an oven chamber 3 to permit a heat generated as the anode cylinder 7 to be effectively conducted to the wall of the oven chamber 3. The anode cylinder 7 is made of magnetic material and acts as a magnetic yoke 11.

In the microwave heating apparatus 1 shown in FIG. 2 a heat generated due to an anode loss is conducted through the anode cylinder 7 directly to an air in the oven chamber 3, and also from the anode cylinder 7 to the oven chamber wall 5 to permit the air in the oven chamber 3 to be heated indirectly through the oven chamber wall 5. As a result, a substance 4 to be heated is heated and the heat resulting from the anode dissipation is effectively used. This embodiment obviates the necessity of providing a cooling fin, an air blowing fan etc. and permits an effective heating of the substance 4, providing a low-cost compact microwave heating apparatus. This embodiment is suitable particularly for and application to a magnetron having a relatively short operation time.

Figure 3:
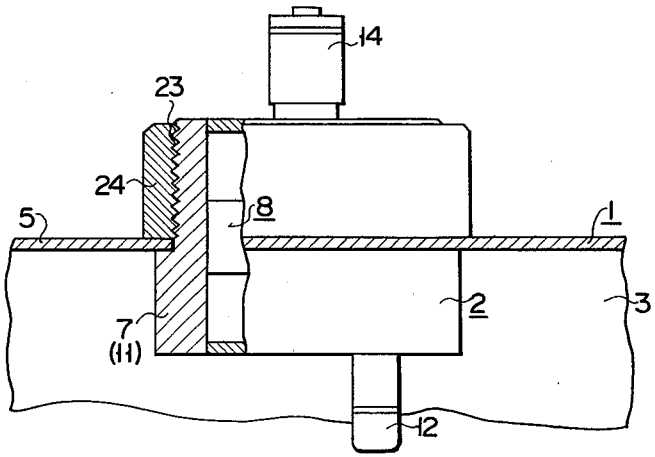
FIG. 3 is a cross-sectional view partly showing another modified form of the microwave heating apparatus shown in FIG. 1.

FIG. 3 shows a modified form of the microwave heating apparatus in FIG. 2. In the embodiment in FIG. 3 the whole of a magnetron body is not disposed within an oven chamber 3. That is, the lower half large diameter section of an anode cylinder 7 including an output antenna 12 is positioned in a heating oven chamber 3. To explain more in detail, an externally threaded portion 23 is provided in the outer periphery of the upper half small diameter section of the anode cylinder 7.

The upper half externally threaded section of the anode cylinder 7 is inserted in an opening in the top wall 5 of the oven chamber 3 and a cylindrical fastening member 24 is screw threaded over the upper half externally threaded section of the anode cylinder 7 to cause the lower end of the fastening member 24 to abut against the top outer wall of the oven chamber. As a result, a magnetron 2 is mounted to the top wall of the oven chamber.

The extent to which the magnetron body is inserted into the heating chamber wall 3 depends upon the heat conductivity of the heat oven chamber, the capacity of the oven chamber 3, and the other design considerations. In the embodiment shown, vanes 8 with a highest heat generating power are mounted on the inner surface of the anode cylinder 7 and that portion of the anode cylinder corresponding to the mounting position of the vane is so positioned that it can be in direct contact with the wall of the oven chamber. As already set out above, the anode cylinder 7 must be thermally sufficiently contacted with the wall of the oven chamber.

In the microwave heating apparatus in FIG. 3 a portion of a heat generated from the anode cylinder 7 is conducted to the oven chamber wall 5 and the remaining portion of the heat is emitted in the heating oven chamber 5.

Figure 4:
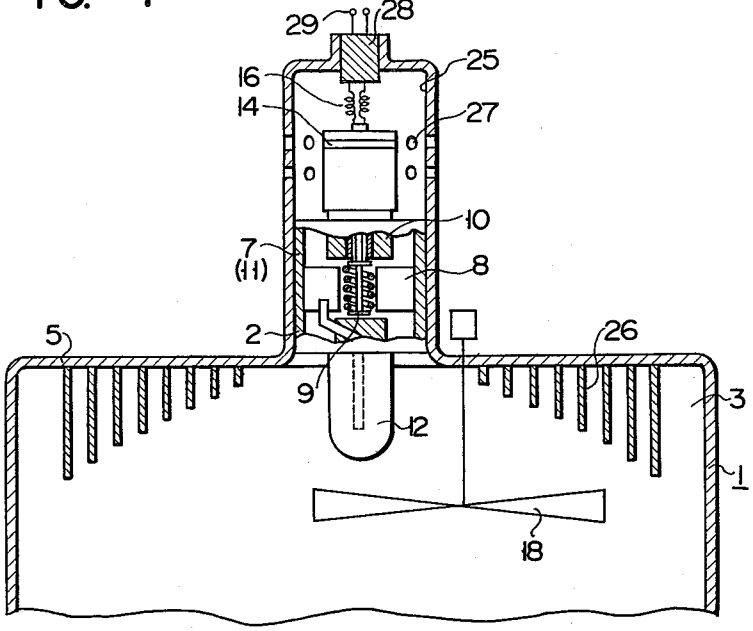
FIG. 4 is a cross-sectional view briefly showing a microwave heating apparatus according to another embodiment of this invention.

FIG. 4 shows a modified form of a microwave heating apparatus. In this arrangement the top wall of an oven chamber 3 is deeply recessed to provide a cylindrical spacing 25 in which almost all magnetron body is mounted unlike the embodiment in FIG. 3. The cylindrical spacing 25 constitutes part of the oven chamber 3. An output antenna 12 may have its part located in the cylindrical spacing 25 or may all be located outside of the cylindrical spacing 25. It is preferred that the cylindrical spacing 25 of the oven chamber 3 be formed by a press work etc. so as to prevent leakage of a mirowave. A plurality of heat emitting fins 26 extend downward from the top inner wall of the oven chamber 5 to permit a heat generated at an anode cylinder 7 to be effectively conducted through the oven chamber wall 5 to an air in the oven chamber 3. A fan is mounted on the top wall of the oven chamber and serves as a stirrer, thus contributing much to a heat connection in the oven chamber. Reference numeral 27 is holes through which a heat generated from a filter element 16 etc. is emitted, and 28 is a condenser through which a lead-in wire 29 is drived out.

In the embodiment shown in FIG. 4 a magnetron including a cathode stem 14, a filter element 16 etc., is all received within the oven chamber 5 so that leakage of a microwave will not occur. Like the above-mentioned embodiments a heat generated due to an anode loss is effectively used to heat a substance 4 to be heated. In order to attain proper operation of the magnetron an air cooling fin may be provided on the outer wall surface of the recessed portion of the oven chamber so that the extent of heat dissipation can be adjusted.

Figure 5:
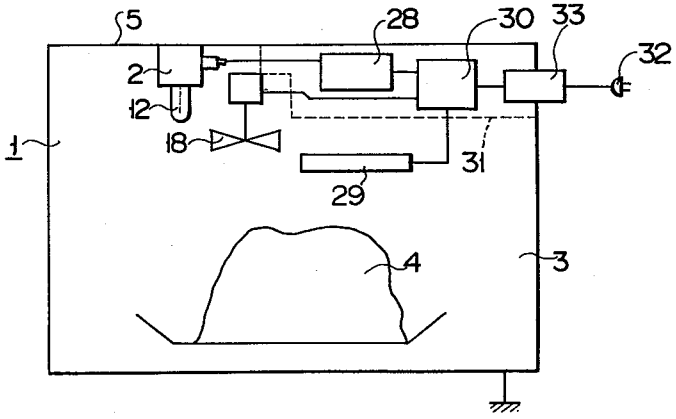
FIG. 5 is a brief explanatory view, partly in block form, showing a microwave heating apparatus according to another embodiment of this invention.

FIG. 5 shows another embodiment of this invention in which the other magnetron operating devices, as well as a magnetron 2, is incorporated within a heating oven chamber. That is, for example, the magnetron 2, a power source device 28 such as a high voltage power source for supplying an input electric power to the magnetron 2, an electric heater 29, a power source device 30 for supplying electric power to a fan 18 are all accommodated within the oven chamber 3. These circuit parts or elements are shielded, as required, by an electric wave shield 31 and a power source cord 32 is connected through a choke element 33 to the power source device 30 so as to prevent leakage of a microwave. The adoption of such an arrangement obviates the necessity of separately connecting filter element to the magnetron, power source devices etc. and more completely prevents leakage of a microwave.

Figure 6:
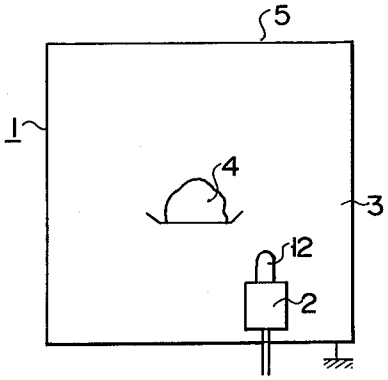
FIG. 6 is a brief explanatory view showing a modified form of a magnetron according to this invention.

FIG. 6 shows another embodiment of this invention in which a magnetron 2 is placed on the bottom wall of an oven chamber 5. In this case, a radiant heat generated from the magnetron is directed directly, and through a natural convection, toward a substance to be heated. A natural convection is properly effected, as compared with the case where the magnetron is mounted on the top inner wall of the oven chamber, permitting an air in an oven chamber 3 to be elevated to a proper level.

From the above explanation it will be understood that the magnetron 2 may be mounted on the side inner wall or the rear inner wall of the oven chamber.

Figure 7:
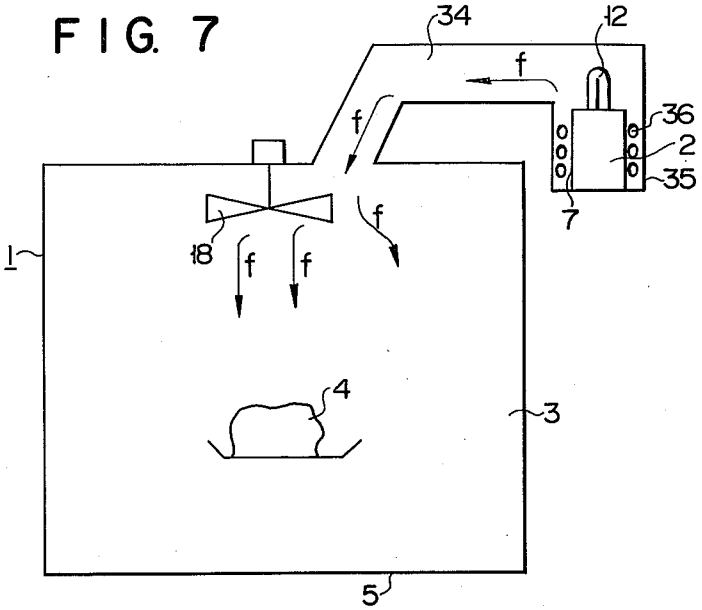
FIG. 7 is a brief explanatory view showing a microwave heating apparatus according to another embodiment of this invention.

FIG. 7 shows another embodiment of this invention in which a microwave is directed through a waveguide 34 into a heating oven chamber 3. In the embodiment shown in FIG. 7 one end of the waveguide 34 communicates with the oven chamber 3 through the top wall of the oven chamber 3 and a magnetron receiving case 35 is located at the other and of the waveguide 34 so that it communicates with the oven chamber 3 for microwave transmission.

In a conventional microwave heating apparatus a magnetron is so arranged within a magnetron receiving case that only an antenna is located within a waveguide. In the apparatus shown in FIG. 7, however, the magnetron 2 is so arranged that an antenna 12 and at least the portion of an anode cylinder 7 are located in the waveguide 34. Outer air introducing holes 36 are also provided in the magnetron receiving case 35 so as to cause the magnetron in the magnetron receiving case to be cooled. Within the oven chamber 3 a fan 18 is mounted in a position near to the mounting position of the waveguide 34 and it functions as a stirrer for permitting heat diffusion. An outer air enters through the holes 36 into the case 35 and it is, after heated by a heat generated from the magnetron, directed as a hot air current, into the heating oven chamber 3.

The waveguide 34 and the magnetron receiving case 35 may be made of a heat-electroconductive materail to permit the magnetron 2 to be thermally contacted with the magnetron receiving case 3, thus transmitting heat from the magnetron to the oven chamber 3. Like the embodiment in FIG. 4 fins 26 may be mounted within the oven chamber to permit the heat generated at the magnetron 2 to be effectively transmitted within the oven chamber.

As mentioned above, a heat generated from the magnetron within the magnetron receiving case 36 is effectively transmitted directly and indirectly to a substance 4 to be heated, thereby heating the substance 4.

Although only the vane type magnetron using a monopole antenna has been explained for convenience of explanation, the other kinds of magnetron as well as the other forms of antenna may be employed without the spirit and scope of this invention.

As will be evident from the above, this invention can provide a microwave heating apparatus capable of eliminating an unnecessary space so as to be made compact and capable of providing a very good heat efficiency.

What is claimed is:

1. A microwave heating apparatus comprising a magnetron including an anode cylinder in which resonance cavities are defined, a cathode disposed within the anode cylinder, an output antenna electrically coupled to the resonance cavities of the anode cylinder and a magnet device for creating a magnetic field in the anode cylinder; a heating oven chamber for receiving a substance to be heated; and a magnetron operating device for operating a magnetron, the improvement in which the output antenna and a greater portion of the anode cylinder are disposed within the heating oven chamber.

2. A microwave heating apparatus according to claim 1, further including an air stirring fan arranged within the heating oven chamber to permit an air current to be forcedly circulated.

3. A microwave heating apparatus according to claim 2, in which said fan serves as a stirrer for stirring a microwave.

4. A microwave heating device according to claim 1, in which said heating oven chamber is divided, by a partition plate made of dielectric material, into two compartments, one of said compartments for the magnetron and the other for a substance to be heated, said partition plate having a hole for permitting an air current to be passed therethrough.

5. A microwave heating device according to claim 1, in which at least one hole is provided in the wall of said oven chamber to permit an outer air to be passed therethrough.

6. A microwave heating device according to claim 1, in which said heating oven chamber receives said magnetron and said magnetron operating device, at least the portion of said magnetron operating device being shielded against electric wave.

7. A microwave heating device according to claim 1, in which said magnetron is disposed at the bottom of said heating oven chamber.

8. A microwave heating apparatus according to claim 1, in which said magnetron is provided with a heat dissipating fin mounted on the outer periphery of the anode cylinder, and is so arranged that said fin, said anode cylinder and output antenna are all disposed within the heating oven chamber.

* * * * *